US005308118A

United States Patent [19]

Ovadia

[11] Patent Number: 5,308,118

[45] Date of Patent: May 3, 1994

[54] CARRY CARD OFFER STRIP

[76] Inventor: Victor A. Ovadia, 1929 Boulevard, West Hartford, Conn. 06107

[21] Appl. No.: 960,717

[22] Filed: Oct. 14, 1992

[51] Int. Cl.[5] ..... B42D 15/00

[52] U.S. Cl. ..... 283/56

[58] Field of Search ..... 283/56, 67, 68, 62, 283/74; 462/8, 15, 25; 281/2, 5

[56] References Cited

U.S. PATENT DOCUMENTS

| | | | |
|---|---|---|---|
| 1,017,007 | 2/1912 | Lipps . | |
| 3,970,332 | 7/1976 | Alford, Jr. . | |
| 4,010,964 | 3/1977 | Schechter . | |
| 4,538,833 | 8/1985 | Trikilis . | |
| 4,606,553 | 8/1986 | Nickerson . | |
| 4,641,578 | 2/1987 | Versaci . | |
| 4,726,972 | 2/1988 | Instance . | |
| 4,781,322 | 11/1988 | Humm . | |
| 4,838,580 | 6/1989 | Tuhkanen | 283/56 |
| 4,915,287 | 4/1990 | Volk et al. . | |
| 5,002,313 | 3/1991 | Salvatore . | |
| 5,052,718 | 10/1991 | Gold . | |
| 5,100,180 | 3/1992 | Tucker . | |
| 5,102,168 | 4/1992 | Gold . | |
| 5,141,254 | 8/1992 | Ring . | |

*Primary Examiner*—Timothy V. Eley
*Assistant Examiner*—Willmon Fridie, Jr.
*Attorney, Agent, or Firm*—McCormick, Paulding & Huber

[57] ABSTRACT

A carry card comprised of a sheet of material on which is printed an identification face motion for identifying the user and the company which is responsible for the card and an offer strip portion on which are printed advertiser discount offers. The offers are arranged in such a manner on the offer strip portion as to allow the sheet to be folded into creditcard shape and size with the identification face portion being outwardly directed.

10 Claims, 3 Drawing Sheets

CARRY CARD OFFER STRIP

BACKGROUND OF THE INVENTION

This invention relates to a coupon strip capable of being distributed in bulk, for example, by direct mailing to consumers, and deals more particularly with a carry card presenting offers for cash discounts to consumers in a discernable manner on a strip capable of being folded in such a manner as to take on a business card or a passport-size shape for easy holding by the user.

Coupons distributed through mass mailing efforts offering cash discounts on products and services by particular vendors to consumers often involve stuffing numerous coupons into envelopes for each mailing. The envelopes and the many coupons enclosed in the envelopes, once received by the consumer in the mailer, are often inadvertently discarded or lost given that they are not usually bound to one another. In response to this, U.S. Pat. No. 4,010,964 issued on Mar. 8, 1977 discloses a printed coupon folder in which the coupons are detachably connected to one another and are arranged end-to-end in a string which are separated by perforation lines. However, the coupons arranged in this end-to-end manner are folded in a zig-zag manner so as to constitute a package which is bulky and which is ultimately subject to the same drawbacks experienced by the bulk mailing where separate coupon sheets are enclosed in a single envelope. That is, even though the coupons in the U.S. Pat. No. 4,010,963 are originally attached to one another in an end-to-end manner, it is conceivable that individual ones of the coupons will not be used in a sequential order, starting from the ends and working inwardly. Rather, it is more probable that the coupons will become detached intermediate the ends of the strip during use thereby resulting in the strip becoming segmented and parts of these segments being easily lost or discarded. It should be understood that hitherto it was necessary to detach the coupons from the strip because prospective customers had a one-time use for them since they had to be redeemed at the offerers place of business. Also, since carrying around a package of coupons was often bulky and prohibitive in some instances, it is desirous to hold the coupons in a manner which permits them to be easily carried by the consumer as would be done with a credit card or a license in a wallet, for example.

Accordingly, it is an object of the present invention to provide a coupon offer strip which is foldable on itself while yet remaining relatively thin so as to take on the shape of a credit card or other shapes which are specifically sized for known carriers, such as a wallet or a passport holder.

It is a further object of the invention to provide a convenient carrying card of a compact size having multiple reusable offers and which eliminate cutting and sorting of associated coupons heretofore known.

It is yet a further object of the present invention to provide a carrier card of the aforementioned type which is capable of being distributed in bulk by direct mailing to consumers.

SUMMARY OF THE INVENTION

A carry card for displaying in a compact and discernable manner a plurality of advertiser discount offers, the carry card being made from sheet material having a given length and having printed on it an identification face portion and an offer strip portion. The identification face portion has a first given dimension extending in a direction parallel to that of the given length of the sheet material and has a second given dimension extending generally orthogonally to first dimension. The offer strip portion is integrally formed with the identification face portion and includes a plurality of fold lines extending parallel to the second given dimension and being spaced from one another by a distance equal to the value of the first given dimension of the identification face portion.

The invention further resides in an advertising vehicle having a first width dimension and a second length dimension prescribing a given area with the carry card taken as a strip having a third width dimension and a fourth length dimension prescribing a given area thereon. The strip portion fourth length dimension being equal to the vehicle portion first width and the strip portion and the vehicle portion having geometrically complementary side edges extending along the vehicle portion first width and the strip portion fourth length so as to be connected along the complementary side edges.

DETAILED DESCRIPTION OF THE PREFERRED EMBODIMENTS

Figure 1:
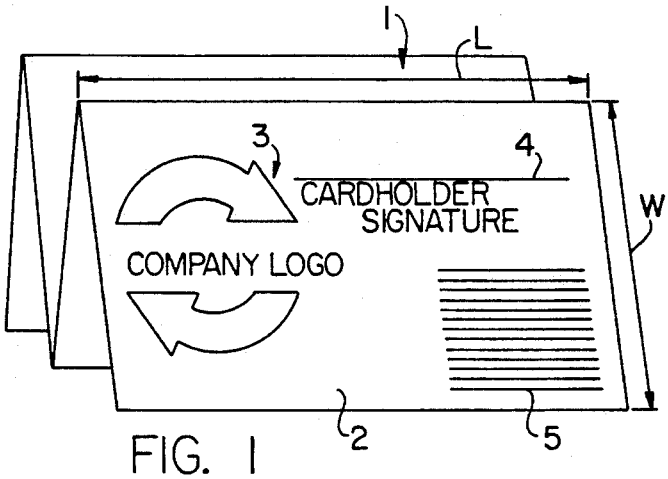
FIG. 1 is a perspective view of the carry card shown in its folded compact condition.

FIG. 1 illustrates the carry card 1 embodying the present invention. The card 1 is folded by the consumer after receipt such that it is capable of being placed in a wallet or other suitable carrying device, such as a passport holder. The card 1 has an identification face portion 2 on which is displayed a logo 3 identifying the strip as a carry card and has an offer strip portion 11 displaying the discounts. For purposes of this disclosure, it should be understood that while the element 1 is referred to as a card, this term is used to apply to both the folded and unfolded conditions of the strip that makes up the card. The identification face portion 2 of the card has a predetermined width W as well as a predetermined length L, with the specific dimension of the width being approximately equal to two inches and the length equal in the amount of three and one-quarter inches in the case where the strip folds to assume a credit card size.

As will hereinafter be discussed in greater detail, the carry card because of its particular adaptability to being reused during a given period time, should include means for making it non-transferable by providing it with appropriate indicia. For this purpose, it is desirable to have printed on the face 2 a signature line 4 in order to limit its use to a single person. In addition to the signature line 4, the face 2 may include other indicia, such as a bar code 5 or a holographic indicia, to identify the user, to track data, such as geographic use, and even to allow for electronic discounting of a purchase price.

Figure 2:
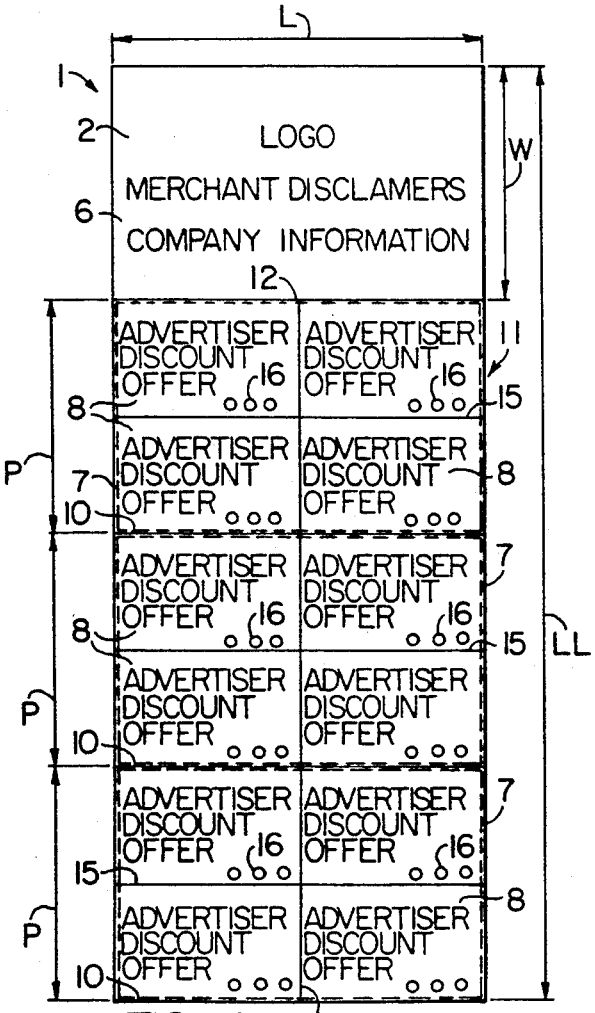
FIG. 2 is a top plan view of the carrier card shown in its unfolded condition.
Figure 3:
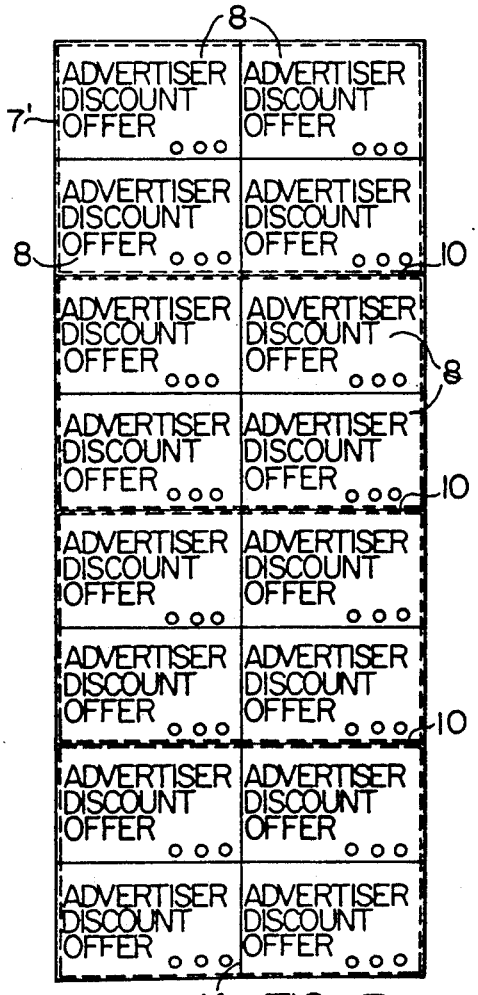
FIG. 3 is the underside view of the carrier card shown in FIG. 2.

Referring now to FIG. 2, it should be seen that the card 1 is in effect a strip or sheet 6 of paper or other suitable material, such as a foldable polymer, having a total length LL equaling approximately nine inches. This length is inclusive of the width W of the identification face portion 2, which, as illustrated, runs parallel to the length dimension LL. Disposed along the length LL of the strip 6 and below the identification face portion 2, are a plurality of offers 8,8 separated in blocks 7,7 from one another by transversely extending fold lines 10,10. The offers begin at a first foldline 12 demarking the end of the identification face portion 2 and the beginning of the offer strip portion 11. The blocks 7,7 which contain the offers 6,6 are each defined by a fold line 10,10 spaced at distances P,P equal to the width W of the identification face portion 2. As is shown in FIG. 3, the back side of the strip 6 includes a series of offers 8,8 which extend completely along the length LL of the strip. The offers 8,8 disposed in the block 7' are printed on the reverse side of the identification face portion 2. Thus, the card 1, when unfolded to reveal its back side, displays an entirety of advertiser discount offers that can be readily viewed by the retailer and the consumer.

In the embodiment shown in FIG. 2, four separate advertising discount offers are printed per block with each block being divided into two equal halves by a major dividing line 14 and thereafter being divided into quarters by a minor dividing line 15. However, it is well within the scope of the invention to eliminate the minor dividing line 15 in each block and to print offers that extend the full length P of the involved block. The fold lines 10,10 being spaced at a distances P,P from one another, and the length P being equal to the width W of the advertising face portion, allows the strip 6 to be folded in a zig-zag or a halfing manner on itself to create a carrier card in which the identification face portion 2 is outwardly disposed. Thus, it should be appreciated that the advertising discount offers or coupons 8,8 which are arranged within blocks 7,7 are uniquely related to the strip 6 and are responsible for the card being conveniently folded a number of times even in excess of two into its compact size.

The fold lines 10,10 serve merely to separate juxtaposed advertising offers and do not serve as separation or perforation lines as is previously known in the prior art. This is because the advertiser discount offer card 1 need be only presented to a would-be retailer without any detaching of coupons being necessary. Here, a mark may be made on the card, for example, by the blackening in one of the circles 16,16 which may be provided on one of the offers 8,8. Alternatively, the indicia 16,16 may be replaced with a marking which is capable of being sensed electronically, such as a bar code. Thus, it is only necessary to insure that the offers 8,8 are capable of being readily unfolded from an otherwise folded condition to reveal a certain offer which can be observed and/or marked by the retailer. Also, the retailer may use receipts which are placed into his or her register to keep an internal accounting against the number of discounts given. These receipts in practice are usually signed with the signature being verified against that which was made on the identification face portion 2 of the carry card.

Figure 4:
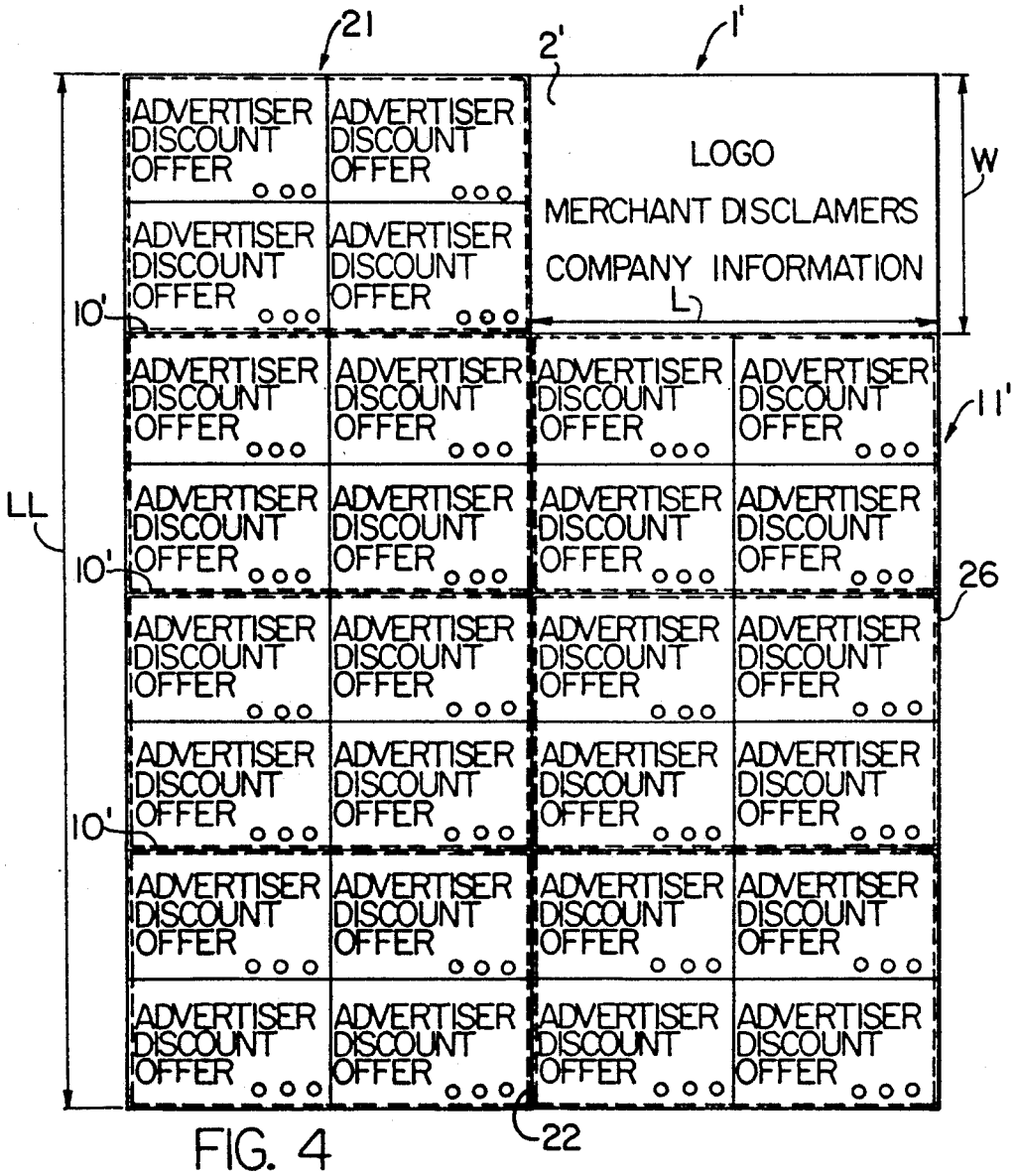
FIG. 4 is an alternative embodiment of the carry card.

Referring now to FIG. 4, it should be seen that a second embodiment of the card 1' is shown. The card 1' as in the case of the strip shown in FIGS. 2 and 3, includes an identification face portion 2' and an offer strip portion 11'. But, in addition to this, the card 1' includes a juxtaposed panel or second strip portion 21. A major fold line 22 extending parallel to the length LL of the card 1' separates the second strip portion 21 from the remainder of the card. In addition to the major fold line 22, the card also has a plurality of minor or transverse fold lines 10',10' each spaced from one another a distance equal to the width W of the identification face 2'. Similarly, the major fold line 22 is likewise located at a distance L from the leading edge 26 of the card, which distance being the length dimension of the identification face portion 2'. The reverse side of the card may be covered completely with advertiser discount offers and are likewise separated into blocks at least by the intersection of the major fold line 22 and the transverse fold lines 10',10'.

To effect its compact carrying size, the card 1' is first folded along the major fold line 22 so as to give the card the same dimension in a transverse sense as that of the card shown in FIG. 2. Subsequently, the card once folded in this manner can be folded upon itself lengthwise along the fold lines 10',10' so as to give it the general compact configuration of the card ultimately shown in FIG. 1. It should be noted however that while a single additional strip or panel 21 is shown in FIG. 4 oriented to the left of the identification face portion 2', it is well within the scope of the invention to have a plurality of such additional panels 21 located possibility, for example, along all four corner edges of the identification face portion 2 with appropriate major and minor fold lines being disposed such that they cause the strip to take the shape of the card shown in FIG. 1.

Figure 5:
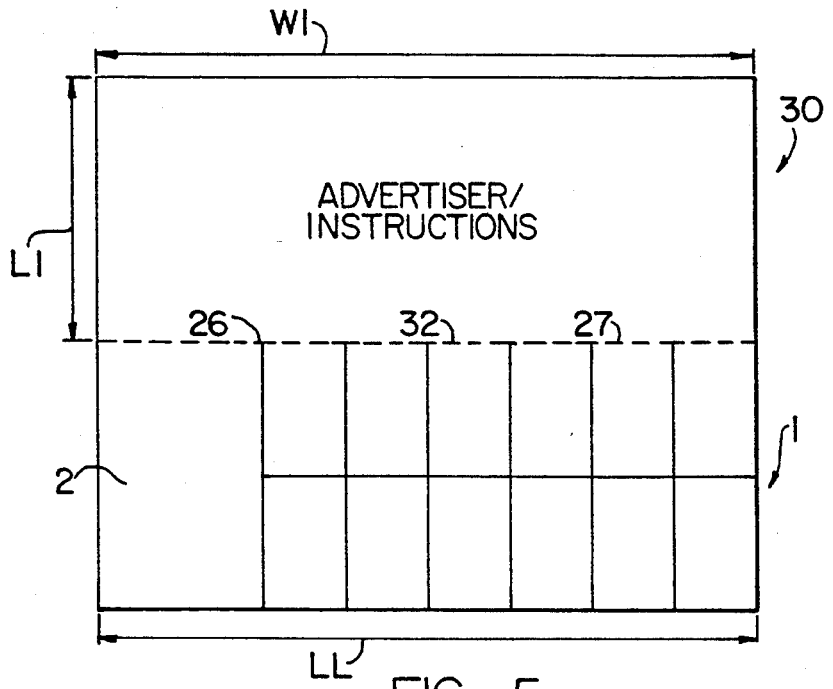
FIG. 5 illustrates the carrier card of FIG. 2 attached to an insert.

Referring now to FIG. 5 and to the carrier card 1 shown attached to a mailer or other distribution vehicle, such as an insert 30, it should be seen that the vehicle 30 is a sheet of paper having a length L1 and a width W1 which defines its given dimensions. The area defined by these dimensions can be used, for example, for advertising the card and/or for giving instructions as to its use. The carry card 1 is preferably attached to the vehicle sheet 1 along complimentary geometric shaped edges 26, 27 and along a perforation line 32 allowing the card to be readily detached from the vehicle sheet for use by the consumer as previously discussed above. As such, the offer strip and the vehicle sheet mate along the perforation line 32 in a one to one corresponding relationship given that the length LL of the strip 6 is equal to the width W1 of the vehicle sheet 30.

Figure 6:
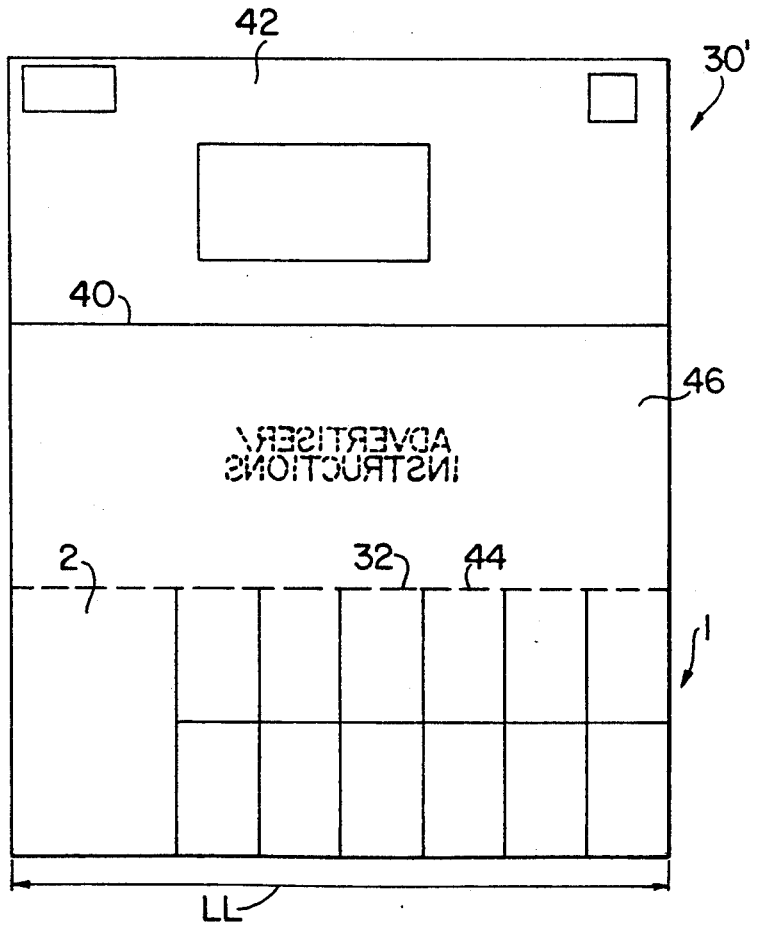
FIG. 6 is an alternative embodiment of a mailer vehicle.

As shown in FIG. 6, the vehicle sheet 30' may assume the character of a bulk mailer sheet having a first portion 42 separated by a first fold line 40 and has a second transverse fold line 44 disposed adjacent to or coincident with the perforation line 32 and defining a second portion 46 thus allowing the sheet to be folded in accordance with the mailing standards of the postal service. The first portion 42 includes indicia for mailing in accordance with standards set by the U.S. postal service. The second portion 46 includes information on use and/or advertising about the carrier card, with the remaining portion 50 being the carrier card itself. It being understood that the indicia printed on the portion 46 is shown in phantom line indicating that it is printed on the inside surface of the sheet relative to the postage markings so that when the mailer is folded, this printed matter is covered. The card, once folded on itself, can be taped to prevent an inadvertent opening during transit.

While the present invention has been described in the preferred embodiment, it should be appreciated that such disclosure has been made by way of illustration rather than limitation. For example, while the advertiser discount offers may be separated by division lines 14,14 for each of the blocks 7,7, it is well within the scope of the invention to provide a single advertisement per block in accordance with the desired space bought by the advertiser. Also, while in FIGS. 5 and 6 it is disclosed to attach the carry card to the vehicle sheet such that it extends along its width, it is nevertheless within the scope of the invention to attach the carry card in its unfolded condition to the vehicle sheet so as to dispose it lengthwise with the sheet and to thereby cause the card to have an increased length dimension.

Accordingly, the application has been disclosed by way of illustration rather than limitation.

I claim:

1. A carry card for displaying in a compact and discernable manner a plurality of advertiser discount offers, said carry card comprising:

sheet material having a given length and a given width and having an identification face portion and offer strip first and second portions, said identification face portion having printed thereon a logo identifying said carry card, and said offer strip first and second portions having printed thereon at least one advertiser discount offer;

said identification face portion having a first given dimension extending in a direction parallel to the direction of said given length of said sheet material and has a second given dimension extending generally orthogonally to the first given dimension and parallel to said given width of said sheet material;

said offer strip portion being nondetachably integrally formed with said identification face portion and including a plurality of fold lines extending parallel to said second given dimension of said identification face portion and being spaced from one another by a distance equal to the first given dimension of said identification face portion, said fold lines dividing said offer strip first and second portions into blocks having third and fourth dimensions equal respectively to the first and second given dimensions of said identification face portion;

at least one advertiser discount offer is printed in at least one of said blocks;

said carry card second strip portion being disposed along one common side edge of said identification face portion and said offer strip first portion and having a length extending with said given length of said sheet material, said second strip portion being separated from said first strip portion and from said identification face portion by one of said plurality of fold lines extending parallel to the given length of the sheet material.

2. A carry card as defined in claim 1 further characterized in that said identification face portion and said strip portion are connected along one of said plurality of fold lines.

3. A carry card as defined in claim 2 further characterized by said blocks each having at least one advertiser discount offer printed in it and said length of said sheet material being defined on one side by said identification face portion and said offer strip portion and said carry card having another opposite side on which said advertiser discount offers are printed along the total length of said sheet.

4. A carry card as defined in claim 3 further characterized by said carry sheet material given width being defined by a dimension equal to two times the second given dimension of said identification of face portion, said carry card second strip portion having a length equal to said given length of said sheet such that some advertiser discount offers are located in a side-by-side juxtaposed position with said identification face portion of said card.

5. A carry card as defined in claim 5 further characterized in that said second strip and said offer strip portion and said identification face portion being connected along a major fold line extending parallel to said length of said identification face portion and said strip portion.

6. A carry card as defined in claim 2 further characterized by said given width of said carry card being equal to the second given dimension of said identification face portion.

7. A carry card as defined in claim 2 further characterized in that said identification face portion of said carry card includes machine readable indicia.

8. A carry card as defined in claim 2 further characterized in that said identification face portion of said carry card includes a signature line identifying the user.

9. A carry card for displaying in a compact and discernable manner a plurality of advertiser discount offers, said carry card comprising:

sheet material having a given length and a given width and having an identification face portion and offer strip first and second portions, said identification face portion having printed thereon a logo identifying said carry card, and said offer strip first portion having printed thereon at least one advertiser discount offer;

said identification face portion having a first given dimension extending in a direction parallel to the direction of said given length of said sheet material and has a second given dimension extending generally orthogonally to the first given dimension and parallel to said given width of said sheet material;

said offer strip first portion being nondetachably integrally formed with said identification face portion and including a plurality of fold lines extending parallel to said second given dimension of said identification face portion and being spaced from one another by a distance equal to the first given dimension of said identification face portion, said fold lines dividing said offer strip first and second portions into blocks having third and fourth dimensions;

at least one advertiser discount offer is printed in at least one of said blocks;

said carry card second strip portion being disposed along one common side edge of said identification face portion and said first offer strip portion and having a length extending with said given length of said sheet material, said second strip portion being separated from said identification face portion and said first strip portion by one of said plurality of fold lines extending parallel to the given length of the sheet material.

10. A carry card as defined in claim 2 further characterized in that each of said blocks containing an advertiser discount offer including machine readable indicia.

* * * * *